US009681228B2

(12) United States Patent
Wilk et al.

(10) Patent No.: US 9,681,228 B2
(45) Date of Patent: Jun. 13, 2017

(54) CAPACITIVE POSITION SENSING FOR TRANSDUCERS

(71) Applicant: Apple Inc., Cupertino, CA (US)

(72) Inventors: Christopher Wilk, Los Gatos, CA (US); Alexander V. Salvatti, Morgan Hill, CA (US); Thomas M. Jensen, San Francisco, CA (US); Scott P. Porter, San Jose, CA (US); Ruchir M. Dave, San Jose, CA (US); Andrew P. Bright, San Francisco, CA (US); Roderick B. Hogan, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/679,807

(22) Filed: Apr. 6, 2015

(65) Prior Publication Data

US 2016/0094917 A1 Mar. 31, 2016

Related U.S. Application Data

(60) Provisional application No. 62/057,743, filed on Sep. 30, 2014.

(51) Int. Cl.
*H04R 9/02* (2006.01)
*H04R 7/16* (2006.01)
(Continued)

(52) U.S. Cl.
CPC ..... *H04R 3/007* (2013.01); *H04R 9/06* (2013.01); *H04R 2499/11* (2013.01)

(58) Field of Classification Search
CPC ..... H04R 9/02
(Continued)

(56) References Cited

U.S. PATENT DOCUMENTS 4,607,382 A 8/1986 Dijkstra et al.
5,197,104 A 3/1993 Padi
(Continued)

FOREIGN PATENT DOCUMENTS

GB 2 408 404 A 5/2005
WO WO 2004/082330 A1 3/2004
WO WO 2014045123 A1 3/2014

OTHER PUBLICATIONS

Simple Optical Microphone/Pickup, Scanlime, One Girl's Diary of Improvisational Engineering, Feb. 3, 2010, 8 pgs., http://scanlime.org/2010/02/simple-optical-microphonepickup/.

*Primary Examiner* — Matthew Eason
*Assistant Examiner* — Phan Le
(74) *Attorney, Agent, or Firm* — Blakely, Sokoloff, Taylor & Zafman LLP

(57) ABSTRACT

A micro speaker having a capacitive sensor to sense a motion of a speaker diaphragm, is disclosed. More particularly, embodiments of the micro speaker include a conductive surface of a diaphragm facing conductive surfaces of several capacitive plate sections across a gap. The diaphragm may be configured to emit sound forward away from a magnet of the micro speaker, and the capacitive plate sections may be supported on the magnet behind the diaphragm. In an embodiment, the gap provides an available travel for the diaphragm, which may be only a few millimeters. A sensing circuit may sense capacitances of the conductive surfaces to limit displacement of the diaphragm to within the available travel.

19 Claims, 9 Drawing Sheets

(51) Int. Cl.
*H04R 3/00* (2006.01)
*H04R 9/06* (2006.01)

(58) Field of Classification Search
USPC ..... 381/398, 311
See application file for complete search history.

(56) References Cited

U.S. PATENT DOCUMENTS

| | | | | |
|---|---|---|---|---|
| 5,461,676 | A | 10/1995 | Hobelsberger | |
| 5,493,620 | A | 2/1996 | Pulfrey | |
| 7,565,178 | B1 | 7/2009 | Sitachitt et al. | |
| 8,126,138 | B2 | 2/2012 | Dinh et al. | |
| 2003/0048911 | A1 | 3/2003 | Furst et al. | |
| 2004/0184623 | A1 | 9/2004 | Johannsen et al. | |
| 2007/0121967 | A1* | 5/2007 | Sjursen | H04R 19/016 381/111 |
| 2009/0274336 | A1 | 11/2009 | Infanti | |
| 2011/0007914 | A1* | 1/2011 | Li | H04R 1/04 381/191 |
| 2012/0177215 | A1* | 7/2012 | Bose | G01D 5/2417 381/74 |
| 2013/0163767 | A1 | 6/2013 | Gauger, Jr. et al. | |
| 2013/0177185 | A1 | 7/2013 | Takahashi et al. | |
| 2014/0177881 | A1 | 6/2014 | Fanget et al. | |

* cited by examiner

CAPACITIVE POSITION SENSING FOR TRANSDUCERS

This application claims the benefit of U.S. Provisional Patent Application No. 62/057,743, filed Sep. 30, 2014, and this application hereby incorporates herein by reference that provisional patent application.

BACKGROUND

Field

Embodiments related to an audio speaker having a capacitive sensor to sense motion of a speaker diaphragm are disclosed. More particularly, an embodiment related to a micro speaker having a diaphragm that emits sound forward away from a motor assembly, is disclosed.

Background Information

An audio speaker driver converts an electrical audio input signal into an emitted sound. Audio speaker drivers typically include a diaphragm connected with a motor assembly, e.g., a voicecoil and a magnet. Thus, when the electrical audio input signal is input to the voicecoil, a mechanical force may be generated that moves the diaphragm to generate sound. Loudspeaker drivers may be divided into two broad classes—"direct radiators", which couple the diaphragm to the air directly, and "compression drivers", which use a "phase plug" as an impedance matching device to improve electroacoustical conversion efficiency. Micro speakers, also known as microdrivers, are typically considered a subclass of the direct radiator class, generally meaning a miniaturized implementation which is intended to operate over a broad frequency range with significant diaphragm excursion relative to the diaphragm size, as opposed to a tweeter, which is designed to cover primarily the highest audible frequencies, implying extremely small diaphragm excursion requirements relative to its size. Microdrivers may radiate sound in a forward (front firing) or sideways (side firing) configuration, depending on the particular design goals. A driver typically includes an available excursion space for the diaphragm, over which the diaphragm may move without crashing into other driver components. The available travel in micro speakers is typically on the same order of magnitude as compression drivers, which tends to be significantly smaller compared to typical larger direct radiator transducers.

SUMMARY

Audio speakers having a capacitive sensor to sense motion of a speaker diaphragm, particularly for use in portable consumer electronics device applications, are disclosed. In an embodiment, a micro speaker includes a diaphragm coupled with a motor assembly. The motor assembly may include a voicecoil and a magnet configured to move the diaphragm to emit sound forward and away from the magnet. Furthermore, the diaphragm may include a conductive surface facing the magnet and attached to the diaphragm. Several capacitive plate sections may be supported on the magnet. Thus, several variable capacitors may be formed between the diaphragm and the capacitive plate sections outside of the sound path.

In an embodiment, the micro speaker includes at least three capacitive plate sections behind the diaphragm. More particularly, the capacitive plate sections may be separated by one or more slot, which may be partly filled with an insulating filler or another dielectric. For example, four capacitive plate quadrants may be separated and/or electrically insulated from each other by a pair of intersecting slots that are air-filled. The capacitive plate sections may also be insulated from the magnet that supports them, e.g., by a thin insulating layer. In an embodiment, the slots extend through the capacitive plate sections, the insulating layer, and the magnet such that the magnet includes several magnet portions electrically insulated from each other by the pair of intersecting slots. Thus, the magnetic structure behind the diaphragm may be segmented, and each segment may support a different capacitive plate segment, which forms a portion of a variable capacitor.

In an embodiment, a sensing circuit may be electrically connected with each variable capacitor, and more particularly, with the capacitive plate sections. That is, electrical leads may extend from respective capacitive plate sections to electrically connect the capacitive plate sections with the sensing circuit. In an embodiment, pairs of the variable capacitors may be electrically in series through the diaphragm. Furthermore, the sensing circuit may connect with multiple groups of the serially connected variable capacitor pairs. Thus, the electrical leads may convey signals for the variable capacitor pairs to the sensing circuit. Those signals may correspond to capacitance of the variable capacitors. Thus, the sensing circuit may be configured to measure the capacitance and to calculate displacement and position of the diaphragm based on the signals. Monitoring diaphragm position in this way may avoid speaker damage or undesirable acoustic distortion, given that the micro speaker may include limited available travel for the diaphragm. For example, the diaphragm may be separated from the capacitive plate sections in a rearward direction by a small gap, e.g., less than 3 mm.

In an embodiment, the diaphragm may be controlled based on the monitored position. A relative spatial orientation between the diaphragm and the capacitive plate sections may be determined based on the calculated displacement of the diaphragm. More particularly, respective distances between the diaphragm and pairs of capacitive plate sections may be calculated to determine absolute position of the diaphragm in multiple axes. Based on the absolute position, the sensing circuit may detect whether the diaphragm is rocking relative to the magnetic structure. In an embodiment, an electrical driving signal is provided to the voicecoil of the micro speaker to drive the diaphragm to a desired position. For example, the diaphragm may be driven to the limit of the available travel of the diaphragm (without exceeding the limit) and/or may be driven to reduce or eliminate non-axial rocking motions.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
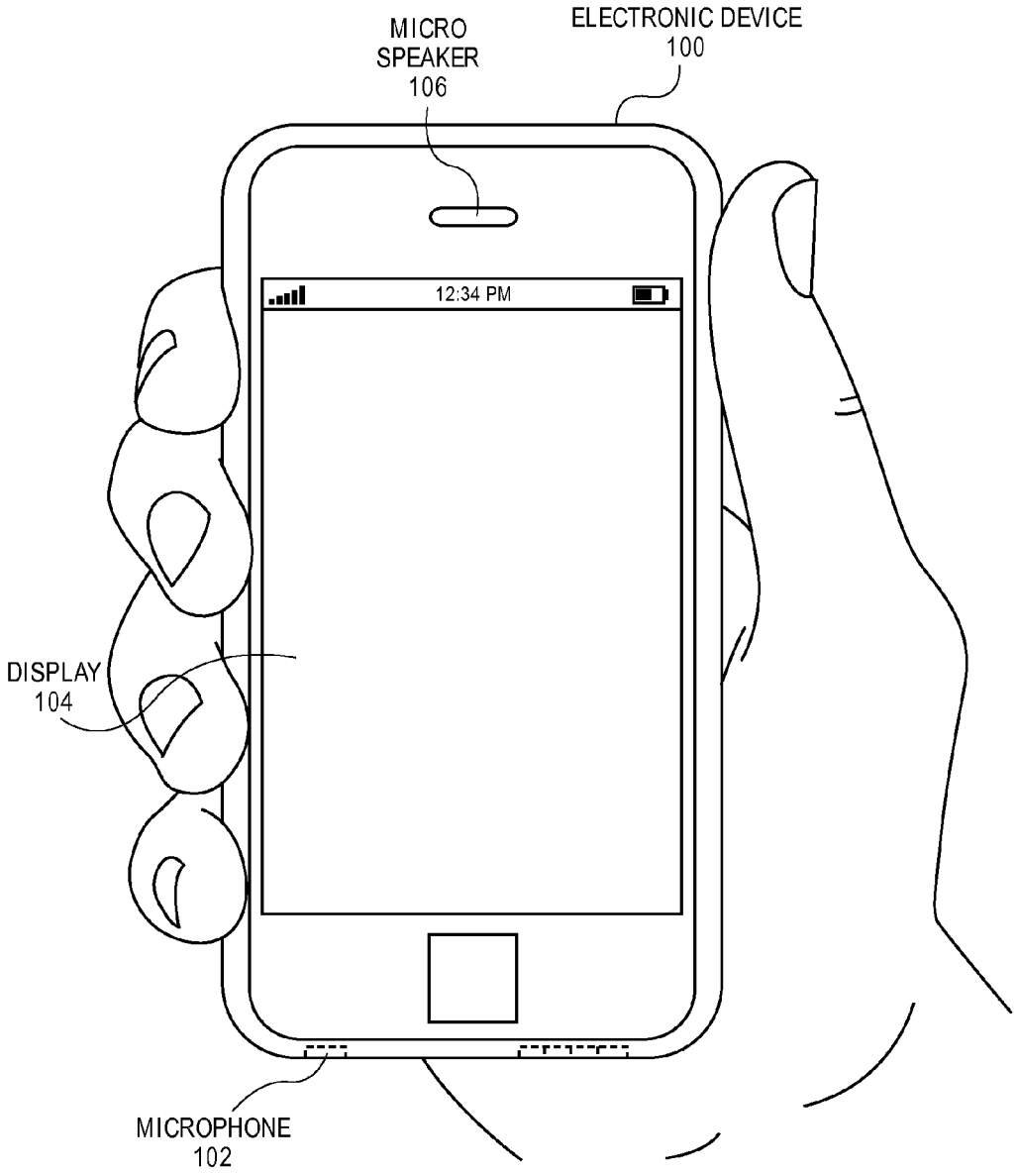
FIG. 1 is a pictorial view of an electronic device having a micro speaker in accordance with an embodiment.

Embodiments describe micro speakers having a capacitive sensor to determine a motion of a speaker diaphragm, particularly for use in portable consumer electronics device applications. However, while some embodiments are described with specific regard to integration within mobile electronics devices such as handheld devices, the embodiments are not so limited and certain embodiments may also be applicable to other uses. For example, a micro speaker as described below may be incorporated into headphones. Furthermore, the micro speaker may be incorporated into systems that remain at a fixed location, e.g., an automated teller machine, or used in a relatively stationary application, e.g., as part of a car infotainment system.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description may denote a relative position or direction. For example, "forward" may indicate a first axial direction away from a reference point. Similarly, "behind" may indicate a location in a second direction from the reference point opposite to the first axial direction. However, such terms are not intended to limit the use of an audio speaker to a specific configuration described in the various embodiments below. For example, a micro speaker may be oriented to radiate sound in any direction with respect to an external environment, including upward toward the sky and downward toward the ground.

In an aspect, a micro speaker includes a series of variable capacitors to sense a position of a diaphragm that emits sound forward away from a motor assembly behind the diaphragm. In an embodiment, the variable capacitors include several electrically insulated capacitive plate sections behind the diaphragm, which have respective conductive surfaces facing a conductive surface on the diaphragm. Given that the variable capacitors share the conductive surface of the moving diaphragm, the variable capacitors may be electrically connected in series without requiring a direct electrical connection to the diaphragm. Furthermore, the variable capacitors behind the diaphragm remain out of the path of sound pressure waves. Thus, the serially arranged capacitive sensors may provide a mechanically stable option for sensing position of the diaphragm.

In an aspect, a micro speaker includes a series of variable capacitors electrically connected with a sensing circuit. The sensing circuit may be connected to the series of variable capacitors to detect the diaphragm position in real time. More particularly, the diaphragm position may be determined based on real time measurements of capacitances of the variable capacitors. Accordingly, the diaphragm position and/or displacement may be used for active control of the driver behavior. For example, displacement values may be calculated and used to drive the diaphragm within an available travel such that the excursion limits of the diaphragm are approached, but not exceeded. This may optimize acoustic performance and output of the micro speaker.

In an aspect, a micro speaker includes at least three variable capacitors electrically connected with a sensing circuit. For example, the variable capacitors may include four capacitive plate sections arranged in quadrants behind the diaphragm. Pairs of the quadrants may be electrically connected through a conductive portion of a speaker diaphragm to create serially arranged variable capacitors. Each quadrant may be supported by a magnet of a speaker motor assembly, and the magnet may be divided into several magnet portions to electrically insulate each capacitive plate section from an adjacent capacitive plate section and/or magnet portion. Accordingly, capacitance between the diaphragm and the capacitive plate quadrants may be sensed to determine diaphragm motion in multiple axes. That is, non-axial motion of the diaphragm, such as rocking modes, may be sensed by the sensing circuit by monitoring multiple pairs of capacitive plate quadrants located on the magnet. Furthermore, the electrical audio input signal may be adjusted to reduce or eliminate non-axial motion of the diaphragm.

Referring to FIG. 1, a pictorial view of an electronic device having a micro speaker is shown in accordance with an embodiment. Electronic device 100 may be a smartphone device. Alternatively, it could be any other portable or stationary device or apparatus incorporating an audio speaker, e.g., a micro speaker 106, such as a laptop computer or a tablet computer. Electronic device 100 may include various capabilities to allow the user to access features involving, for example, calls, voicemail, music, e-mail, internet browsing, scheduling, and photos. Electronic device 100 may also include hardware to facilitate such capabilities. For example, an integrated microphone 102 may pick up the voice of its user during a call, and a micro speaker 106 may deliver a far-end voice to the near-end user during the call. The micro speaker 106 may also emit sounds associated with music files played by a music player application running on electronic device 100. A display 104 may present the user with a graphical user interface to allow a user to interact with electronic device 100 and applications running on electronic device 100. Other conventional features are not shown but may of course be included in electronic device 100.

Figure 2:
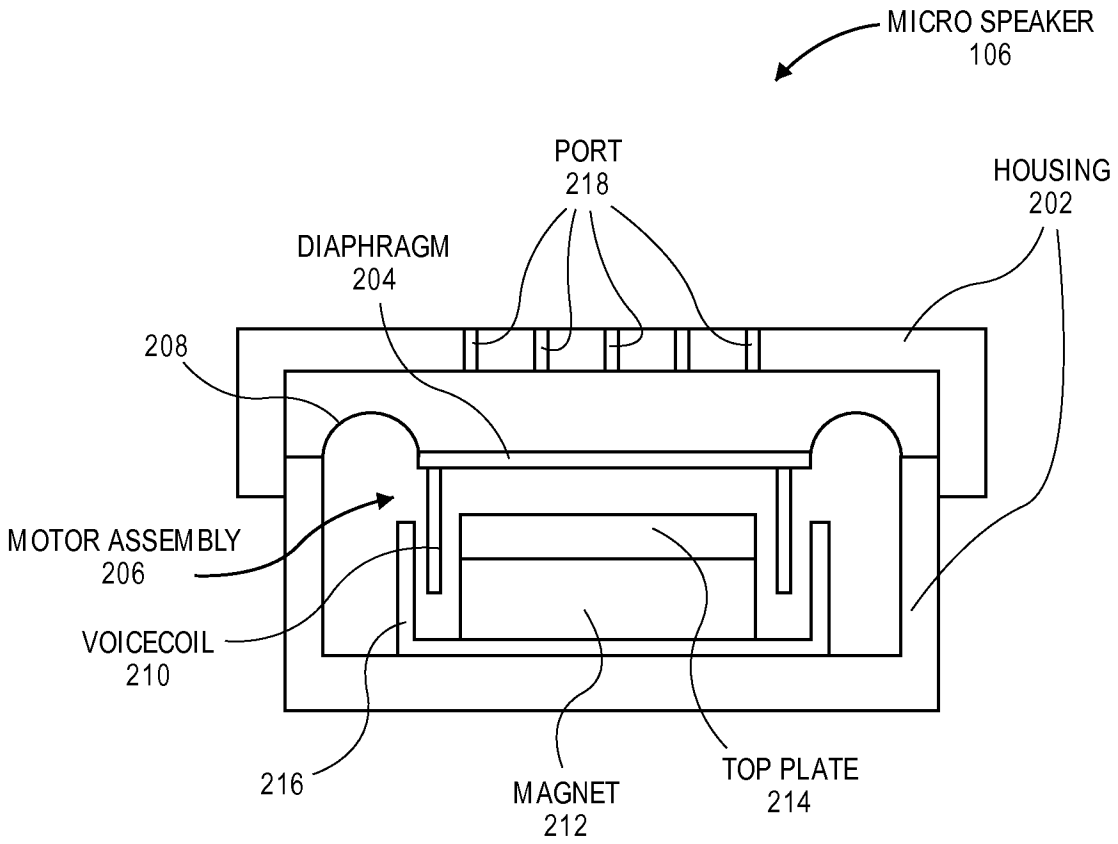
FIG. 2 is a sectional view of a micro speaker in accordance with an embodiment.

Referring to FIG. 2, a sectional view of a micro speaker is shown in accordance with an embodiment. A micro speaker 106 may include a housing 202 surrounding a diaphragm 204 and a motor assembly 206. Motor assembly 206 may include a voicecoil 210 and a magnet 212. More particularly, diaphragm 204 may be connected to housing 202 by a speaker surround 208 that allows diaphragm 204 to move axially with pistonic motion, i.e., forward and backward. Furthermore, diaphragm 204 may be connected to voicecoil 210 of motor assembly 206, which moves relative to magnet 212 of motor assembly 206. In an embodiment, magnet 212 is attached to a top plate 214 at a front face and to a yoke 216 at a back face. Magnet 212 may include a permanent magnet and both top plate 214 and yoke 216 may be formed from magnetic materials to create a magnetic circuit having a magnetic gap within which voicecoil 210 may oscillate forward and backward. Thus, when an electrical audio input signal is input to the voicecoil 210, a mechanical force may be generated that moves diaphragm 204 to radiate sound forward through one or more ports 218 in housing 202.

Micro speakers 106 are commonly incorporated in handheld devices, such as electronic device 100, or other device applications having tight space requirements. Thus, an available travel distance of diaphragm 204 in micro speaker 106 may be limited. For example, diaphragm 204 may be separated from housing 202 on a front side and/or top plate 214 on a rear side by only a few millimeters or in some cases less than 1 mm of available travel. To prevent diaphragm 204 from contacting housing 202 or top plate 214 during use, the driver design may include dimensional tolerances that account for an expected frequency-dependent diaphragm displacement. However, given that frequency response can vary based on operating temperatures, material nonlinearities such as creep, acoustic loading, and/or aging of the driver, the dimensional tolerances may be difficult to predict accurately. This may result in underestimation of the dimensions, and can result in acoustic distortion or damage to diaphragm 204 if it crashes into an opposing surface. Alternatively, overestimation of the dimensions may result in wasted space, since diaphragm 204 may not fully utilize its available travel, which limits the amount of potential maximum acoustic output, the output being directly proportional to the volume displacement of air by diaphragm 204. Therefore, performance of micro speaker 106 may be improved by incorporating sensors to monitor and control diaphragm displacement such that the available travel is fully utilized without crashing diaphragm 204 into an opposing surface.

Figure 3:
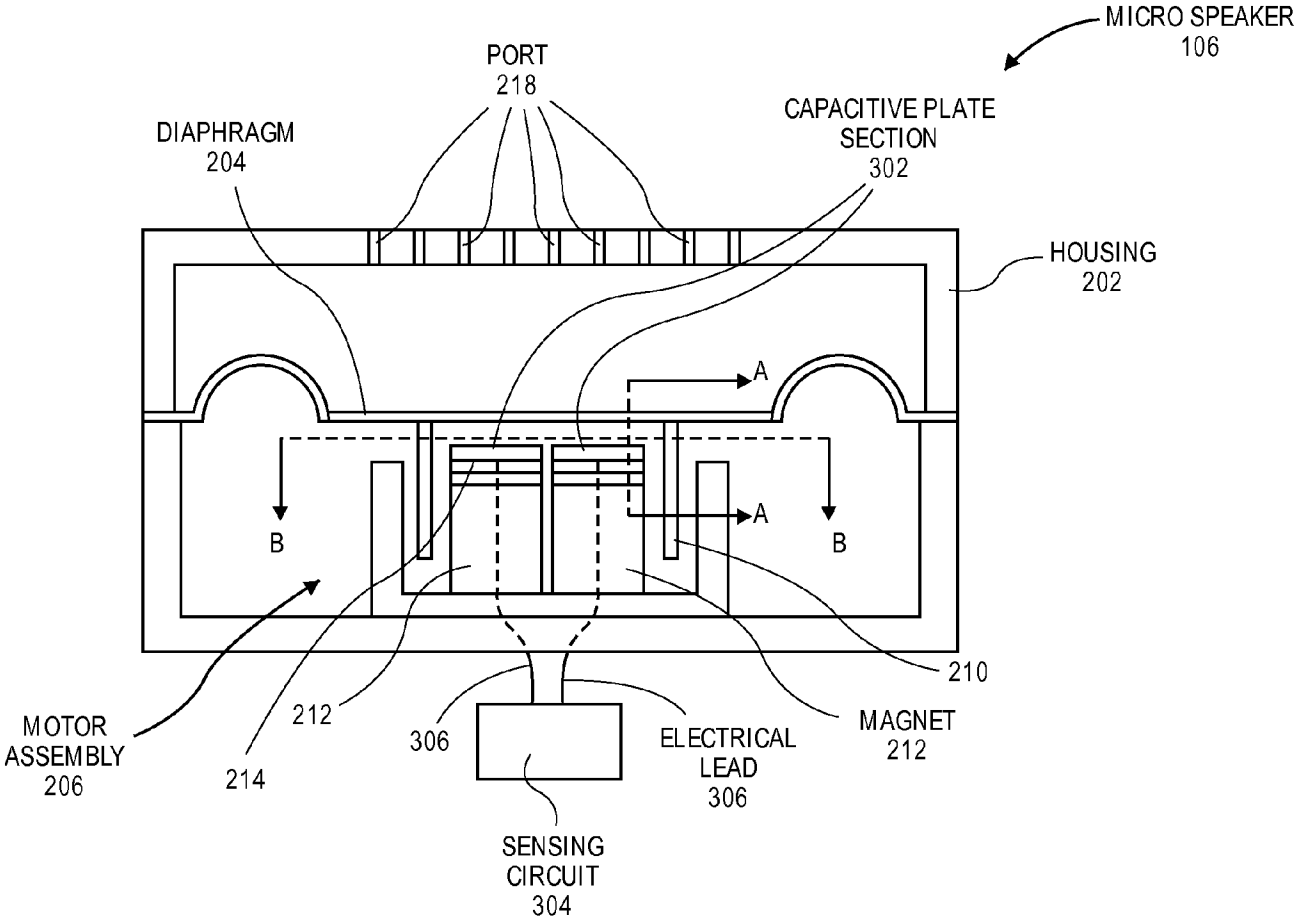
FIG. 3 is a sectional view of a front-firing micro speaker having a capacitive sensor in accordance with an embodiment.

Referring to FIG. 3, a sectional view of a front-firing micro speaker having a capacitive sensor is shown in accordance with an embodiment. Micro speaker 106 may enclose diaphragm 204 and motor assembly 206 such that sound emitted by diaphragm 204, in response to the electrical audio signal input to voicecoil 210, travels forward away from motor assembly 206 and/or magnet 212, and through one or more ports 218 into a surrounding environment. As diaphragm 204 oscillates forward and backward to generate the sound, a back surface of diaphragm 204 may oscillate closer and farther from a front surface of magnet 212. More particularly, in an embodiment, several capacitive plate sections 302 may be supported on magnet 212 behind diaphragm 204, and thus, diaphragm 204 may oscillate closer and farther from the capacitive plate sections 302 during sound generation.

As discussed below, diaphragm 204 and each capacitive plate section 302 may incorporate a conductive material. For example, diaphragm 204 may include a conductive layer disposed over a front or back side, or embedded within the body of diaphragm 204. Similarly, capacitive plate sections 302 may be formed wholly or partially from conductive material. For example, one or more capacitive plate section 302 may include a conductive layer disposed over a front side of magnet 212 or top plate 214. Alternatively, the conductive layer may be embedded within the capacitive plate section 302. For example, capacitive plate section 302 may include a capacitive plate or disc encapsulated or substantially surrounded by a layer of insulation, e.g., an insulated coating. Thus, each capacitive plate section 302 may include a conductive portion that pairs with a conductive portion of diaphragm 204 to essentially form a parallel-plate capacitor. That is, a capacitance may exist for each capacitive plate section 302 and diaphragm 204 pairing. Furthermore, given that the distance between diaphragm 204 and capacitive plate section 302 may vary with movement of diaphragm 204 during sound generation, the capacitances corresponding to each capacitive plate section 302 and diaphragm 204 pairing may also vary. Thus, each pairing may essentially form a variable capacitor.

Capacitance between each pair of conductive surfaces of diaphragm 204 and capacitive plate section 302 will be inversely proportional to the separation distance. Thus, a sensing circuit 304 may be electrically connected with one or more of the capacitive plate sections 302 by one or more electrical leads 306 to receive an electrical signal that may be used to measure capacitance. The measured capacitance may then be used to calculate a corresponding distance between diaphragm 204 and capacitive plate sections 302 based on the known relationship between the capacitance and the separation distance. Similarly, the measured capacitance may be used to determine displacement and motion of diaphragm 204, as discussed below.

Figure 4:
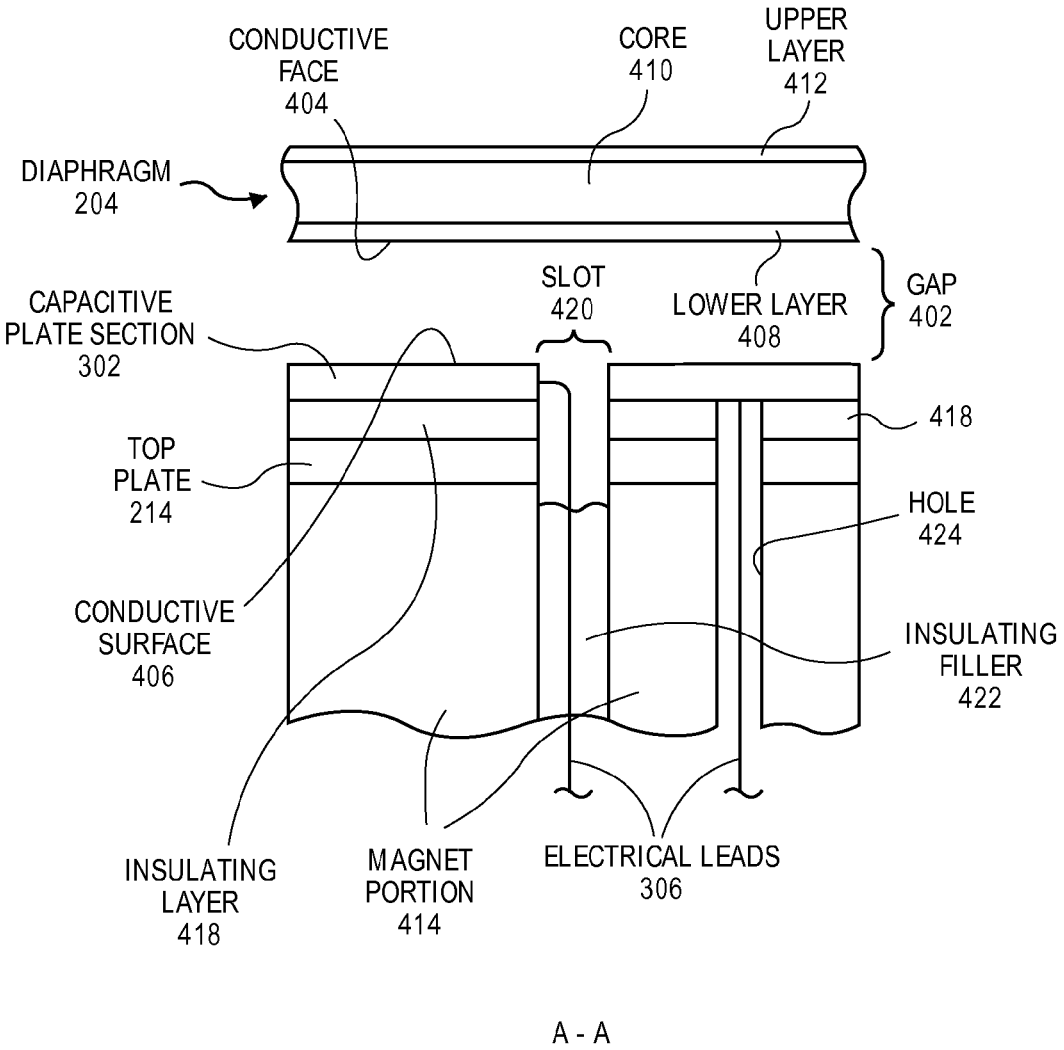
FIG. 4 is a cross-sectional view, taken about line A-A of FIG. 3, of serially arranged variable capacitors of a micro speaker in accordance with an embodiment.

Referring to FIG. 4, a cross-sectional view, taken about line A-A of FIG. 3, of serially arranged variable capacitors of a micro speaker is shown in accordance with an embodiment. In an embodiment, diaphragm 204 is separated from several capacitive plate sections 302 by a gap 402 in an axial direction. The gap distance may be on the order of a few millimeters or less. More particularly, when diaphragm 204 is in a neutral position, such as when no electrical audio input signals are being delivered to voicecoil 210, gap 402 may have an axial dimension of less than 5 mm, and in some cases less than 3 mm. For example, gap 402 may be an air-filled space between a rear conductive face 404 of diaphragm 204 and a front conductive surface 406 of capacitive plate section 302, and the space may have an axial dimension of 1 mm or less. The gap distance may vary as diaphragm 204 moves pistonically during sound generation. However, a maximum gap distance may remain on the order of less than 5 mm when diaphragm 204 is at a maximum forward position. This small gap distance may allow for capacitive sensing to be feasible in the context of micro speaker applications, e.g., in the case of micro speaker 106.

Conductive face 404 may be an outer surface of diaphragm 204 facing magnet 212 of motor assembly 206. More particularly, conductive face 404 may be on outer surface of a lower layer 408 in a laminate structure that forms a portion of diaphragm 204. Lower layer 408 may, for example, be formed from an electrically conductive material, such as an aluminum or copper film. The film may be deposited or otherwise layered over a core 410. Core 410 may be a foam body that is lightweight and rigid, and serves as a substrate for lower layer 408. In an embodiment, diaphragm 204 may also include an upper layer 412. Upper layer 412 may be an aluminum film formed over core 410. Thus, core 410 may be sandwiched between upper layer 412 and lower layer 408, and in an embodiment, core 410 may be less rigid than at least one of lower layer 408 or upper layer 412. As shown, in an embodiment, diaphragm 204 does not require circuitry such as electrical leads or integrated circuits to implement the capacitive sensing capability described below. Without the need for external connections or moving components on diaphragm 204, the diaphragm 204 may be less susceptible to fatigue stress during sound generation, and mechanical stress and possible fatigue failure of the physical connection may be avoided, as compared to a case in which a connection is needed. Furthermore, the layers may be thin, e.g., on the order of 1 nanometer to 100 micron. Thus, diaphragm 204 may remain lightweight such that acoustic performance of diaphragm 204 is not degraded.

In an embodiment, a magnetic structure behind diaphragm 204 may also include a laminated structure. That is, the magnetic structure may include a stack that includes magnet 212 having one or more magnet portions 414 supporting other layers. Each magnet portion 414 may include a permanent magnet material, such as ceramic, ferrite, neodymium, samarium cobalt, etc. The permanent magnet material may be processed to form magnetic portions 414 having a desired geometry, e.g., cylindrical or cuboid shapes. Each magnet portion 414 may support top plate 214. Top plate 214 may include a magnetic material, such as a ferritic steel alloy, and may provide a magnetic core to guide a magnetic field in the magnetic structure, creating a magnetic circuit. An insulating layer 418 may cover an upper surface of top plate 214, to insulate capacitive plate section 302 from other stack layers. For example, insulating layer 418 may be an insulating material that electrically isolates capacitive plate section 302 from top plate 214 and/or magnet portion 414. Accordingly, insulating layer 418 may include an epoxy, a polymer such as parylene, a foam, or any other suitable dielectric material. Capacitive plate section 302 may be stacked on insulating layer 418 with conductive surface 406 facing diaphragm 204 across gap 402.

Capacitive plate sections 302 may be supported directly on top plate 214 or magnet portions 414, i.e., the material of capacitive plate sections 302 may be directly in contact with either top plate 214 or magnet portions 414. Alternatively, capacitive plate sections 302 may be supported directly on insulating layer 418. More particularly, capacitive plate sections may be supported on an upper surface of the respective top plate 214, magnet portion 414, or insulating layer 418, i.e., on a surface nearest diaphragm 204. This contrasts, for example, with supporting the capacitive plate sections 302 on a side surface of top plate 214, magnet portion 414, or insulating layer 418, i.e., on a surface parallel to a surface contour of voicecoil 210. Supporting capacitive plate sections 302 on an upper surface, e.g., on a surface orthogonal to a direction of sound emission by diaphragm 204, may provide for the surfaces of conductive face 404 and capacitive plate sections 302 to face each other.

The conductive surfaces of conductive face 404 and capacitive plate sections 302 may be considered to face each other when the surface contours are substantially parallel to one another. For example, conductive face 404 may be a lower surface of diaphragm 204 having a laminated construction, e.g., may be a lower surface of lower layer 408. Thus, conductive face may extend along a plane that is substantially orthogonal to a central axis along which diaphragm oscillates during sound reproduction. Capacitive plate sections 302, which may be supported on upper surfaces of an underlying magnet portion 414, top plate 214, or insulating layer 418, may also represent a layer of a laminated structure, e.g., of a laminated magnetic structure. As such, conductive surfaces 406 of capacitive plate sections 302 may also span or extend along planes that are substantially orthogonal to the central axis. Accordingly, conductive face 404 and conductive surface 406 may be substantially parallel to each other, and thus, may be considered to face each other in an axial direction (along the central axis or the axis of sound propagation). Furthermore, the faces may be parallel even though lower layer 408 and capacitive plate sections 302 may not span flat planes. For example, in an embodiment, diaphragm 204 may include a conical or curved, e.g., parabolic, surface such that portions of diaphragm extend in varying, non-flat, directions. Accordingly, even though the entirety of conductive face 404 and conductive surface 406 may not be flat, the corresponding contours of the surfaces may nonetheless match. For example, at any location laterally offset from the central axis, the distance between conductive face 404 and conductive surface 406 may be the same. Thus, even though the surfaces may not be flat, the surfaces may nonetheless be considered to be parallel and to face each other.

The height of each layer in the segmented magnetic structure behind diaphragm 204 may be minimized to increase the available travel, and potentially the sound output, of diaphragm 204. Given that the segmented magnetic structure remains stationary during use, i.e., the magnetic structure is not subject to flexing during sound generation, the layers may be made thin without degrading sound quality or leading to mechanical failure of micro speaker 106. Accordingly, in an embodiment, the insulating layer 418 may be formed with a thickness of 5 microns or less, and in some cases less than 3 microns. For example, insulating layer 418 may have a thickness of 1 micron. Similarly, the capacitive plate sections 302 may have thicknesses similar to that of lower layer 408. For example, capacitive plate section 302 may have a thickness between 1 nanometer to 100 micron.

In an embodiment, conductive surface 406 facing conductive face 404 may be a segmented surface. That is, there may be several capacitive plate sections 302, and each section may have a separate conductive surface 406. Each conductive surface 406 may be separated from another by a slot 420. Slot 420 may be sized and configured to electrically isolate a conductive surface 406 of one capacitive plate section 302 from a conductive surface 406 of another capacitive plate section 302. In an embodiment, slot 420 between capacitive plate sections 302 may be filled by a dielectric, such as air. The dielectric may include insulating filler 422, which may be an epoxy, a polymer, or another suitable insulating material, to prevent electrical shorting between conductive surfaces of adjacent capacitive plate sections 302. Thus, slot 420 may be partially filled by a combination of gas, liquid, or solid dielectric materials.

In an embodiment, the entire magnetic structure may be segmented to create individual stacks, including capacitive plate sections 302, supported on respective magnet portions 414. For example, slot 420 may extend axially through capacitive plate section 302, insulating layer 418, top plate 214, and at least a portion of magnet 212 to create adjacent magnet portions 414. In an embodiment, slot 420 extends fully through magnet 212 such that the magnet portions 414 are entirely isolated from each other across slot 420. That is, the magnet portions 414, as well as the layers supported on each magnet portion 414, may be electrically insulated from each other by slot 420. Furthermore, slot 420 may be at least partly filled by insulating filler 422. For example, insulating filler 422 may fill slot 420 between magnet portions 414, but not between the stack over magnet portions 414, i.e., not between top plates 214, insulating layers 418, or capacitive plate sections 302. Alternatively, insulating filler 422 may fill slot 420 such that magnet portions 414 and adjacent stacks of top plates 214, insulating layers 418, or capacitive plate sections 302 are separated across slot 420 by insulating filler 422.

Each pairing of capacitive plate section 302 with diaphragm 204 forms an independent capacitive sensor, i.e., a two-plate variable capacitor, which may be sensed by sensing circuit 304. For example, the pairing of diaphragm 204 with the left capacitive plate section 302 in FIG. 4 may form a variable capacitor that is separate from a variable capacitor formed by diaphragm 204 and the right capacitive plate section 302 in the same illustration. Furthermore, given that the area of conductive face 404 on diaphragm 204 opposite the left capacitive plate section 302 is electrically connected with the area of conductive face 404 opposite the right capacitive plate section 302, the two variable capacitors are electrically in series. That is, the electrical connection between conductive face 404 portions of the variable capacitors may be through a continuous sheet of electrically conductive lower layer 408. In an alternative embodiment, lower layer 408 may be patterned to include multiple distinct conductive face 404 portions opposite the capacitive plate sections 302 and the patterned conductive faces 404 may be connected by electrical leads or traces running over core 410. Patterning of the conductive face 404 portions and the electrical connections may be performed using known fabrication techniques, e.g., deposition techniques.

Electrical leads 306 may be connected to two of the capacitive plate sections 302 to sense a serially arranged pair of variable capacitors. For example, in an embodiment, the segmented capacitive plate includes two capacitive plate sections 302, e.g., the left capacitive plate section 302 and the right capacitive plate section 302 in FIG. 4. Furthermore, the capacitive plate sections are electrically connected in series through the shared conductive face 404 of diaphragm 204. An electrical lead 306 may be connected to the left capacitive plate section 302 to convey electrical signals between the left capacitive plate section 302 and sensing circuit 304. Similarly, an electrical lead 306 may be connected to the right capacitive plate section 302 to convey electrical signals between the right capacitive plate section 302 and sensing circuit 304. Accordingly, the electrical leads 306 may electrically connect the serially arranged variable capacitors with sensing circuit 304.

Electrical leads 306 may extend from capacitive plate sections 302 to sensing circuit 304 in several manners. For example, an electrical lead 306 may extend from a front or side surface of capacitive plate section 302 to sensing circuit 304 through slot 420 formed between capacitive plate sections 302 and magnet portions 414. Alternatively, an electrical lead 306 may extend from a rear surface of capacitive plate section 302 through a hole 424 formed in insulating layer 418, top plate 214, and/or magnet portion 414 to sensing circuit 304. Slot 420 or hole 424 may be at least partly filled by a dielectric, such as insulating filler 422, to insulate and/or stabilize the electrical leads 306 relative to the magnet portions 414. Numerous other electrical lead 306 configurations for connecting capacitive plate sections 302 with sensing circuit 304 may be used. By way of example, vias may extend from capacitive plate sections 302 through magnet portions 414. Alternatively, traces may run along a side surface of magnet portions 414 from capacitive plate sections 302. Thus, several electrical connection schemes may be implemented within the scope of this description. Furthermore, the serially arranged variable capacitors may be electrically connected using the same or different connection schemes.

Figure 5A:
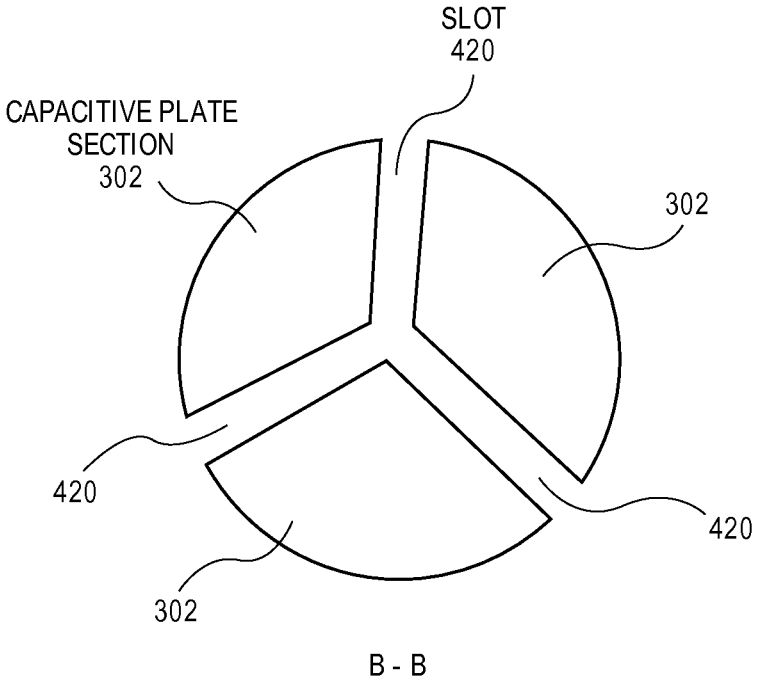
FIGS. 5A-5C are cross-sectional views, taken about line B-B of FIG. 3 viewed in a rearward direction, of capacitive plate sections arranged in accordance with various embodiments.

Referring to FIG. 5A, a cross-sectional view, taken about line B-B of FIG. 3 viewed in a rearward direction, of an arrangement of capacitive plate sections is shown in accordance with an embodiment. The segmented capacitive plate and/or magnet 212 may include more than two sections. For example, a circular capacitive plate may be split into three or more sectors by slot 420. The sectors may be symmetric about a central point or axis at which several slot segments intersect. For example, as shown in FIG. 5A, several slot segments may radiate from a central axis of the magnetic structure. Thus, each capacitive plate section 302 may include a circular sector having an angle between slot segments. The angle may be 120 degrees for each capacitive plate section 302. In alternative embodiments, the circular sectors may not be symmetric, i.e., at least one of the circular sectors may include an arc along an outer edge that subtends an angle of more than, or less than, 120 degrees.

Figure 5B:
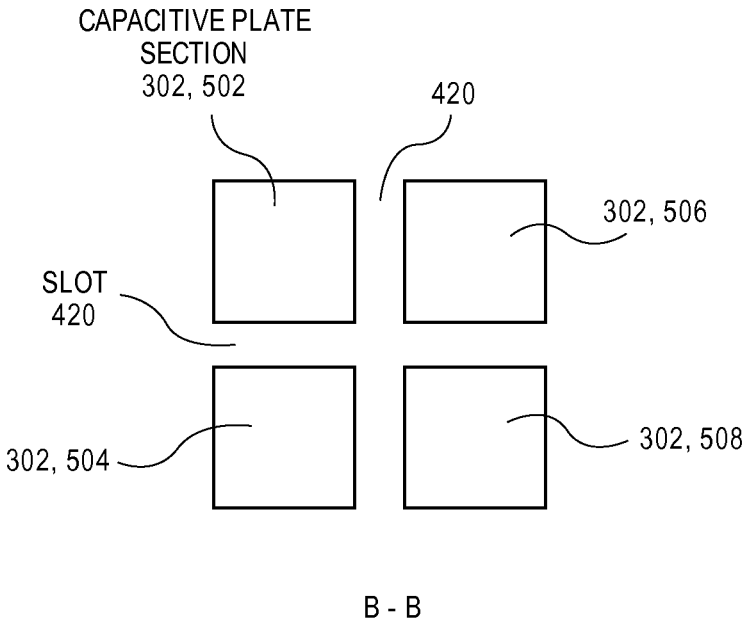

Referring to FIG. 5B, a cross-sectional view, taken about line B-B of FIG. 3 viewed in a rearward direction, of an arrangement of capacitive plate sections is shown in accordance with an embodiment. In an embodiment, the segmented capacitive plate and/or magnet 212 may include more than three sections. For example, the capacitive plate may be split into four or more sectors by slot 420. The sectors may be arranged in a grid pattern. For example, slot 420 may include at least one horizontal slot segment and one vertical slot segment that intersect at a central point. Accordingly, the capacitive plate may be split into quadrants, e.g., capacitive plate quadrants 502, 504, 506, and 508. The quadrants may be arranged in a grid pattern. In an embodiment, additional horizontal and/or vertical slot segments may be added to create a grid having more than four capacitive plate sections 302.

Figure 5C:
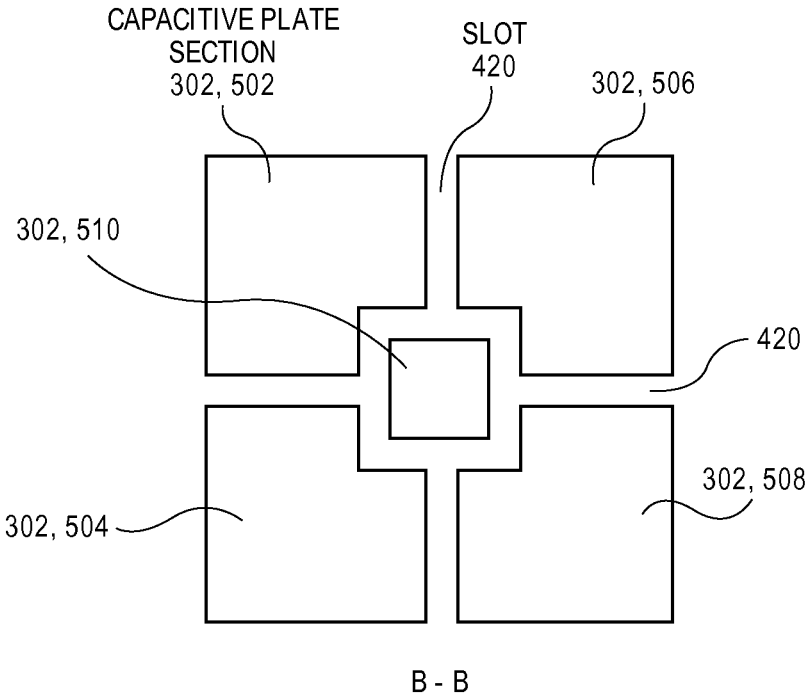

Referring to FIG. 5C, a cross-sectional view, taken about line B-B of FIG. 3 viewed in a rearward direction, of an arrangement of capacitive plate sections is shown in accordance with an embodiment. In an embodiment, the segmented capacitive plate and/or magnet 212 may include a central capacitive plate section 302 surrounded by two or more capacitive plate sections 302. Furthermore, each capacitive plate section 302 may be separated from another by a slot 420 segment. For example, a central capacitive plate section 302, e.g., a square capacitive plate section 302, may be surrounded by a slot 420 segment to create a capacitive plate island 510. Furthermore, two or more capacitive plate sections 302, e.g., four capacitive plate quadrants 502, 504, 506, and 508, may be arranged symmetrically around the capacitive plate island 510 and divided by a horizontal slot 420 segment and a vertical slot 420 segment that radiate from the capacitive plate island 510 (and that would intersect at the center of the capacitive plate if the capacitive plate island 510 were absent from the arrangement).

The examples of capacitive plate section arrangements provided above are not intended to be limiting. More particularly, the principles provided may be extrapolated upon to arrive at a variety of embodiments having three or more capacitive plate sections 302 supported on magnet 212, or segmented magnet portions 414, behind diaphragm 204. Accordingly, the capacitive plate section 302 arrangements discussed above are intended to be illustrative, rather than exhaustive.

Figure 6:
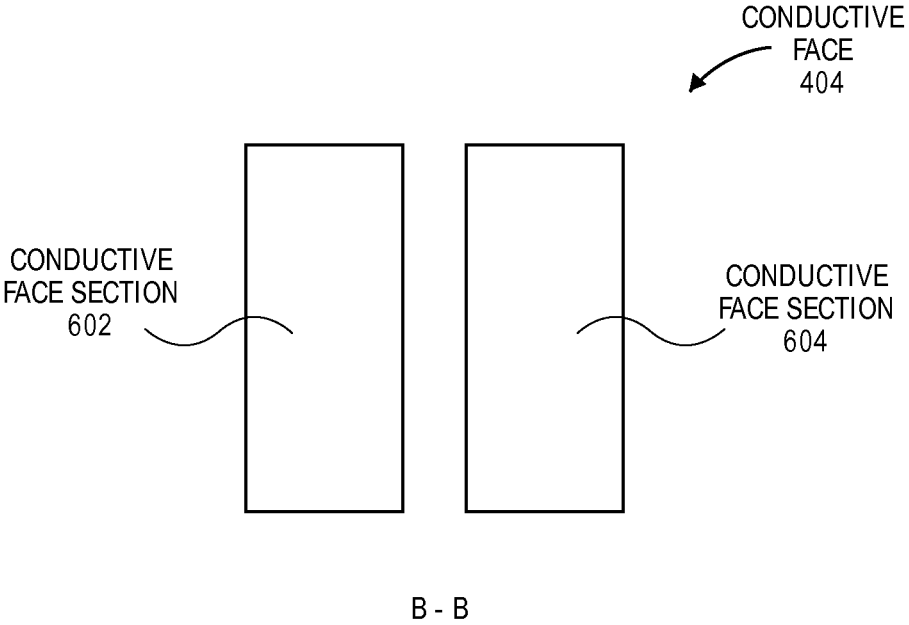
FIG. 6 is a cross-sectional view, taken about line B-B of FIG. 3 viewed in a forward direction, of conductive face sections of a diaphragm in accordance with an embodiment.

FIG. 6 is a cross-sectional view, taken about line B-B of FIG. 3 viewed in a forward direction, of conductive face sections of a diaphragm in accordance with an embodiment. In an embodiment, a metallized portion of diaphragm 204, e.g., conductive face 404 on lower layer 408, may also be segmented to correspond to pairs of capacitive plate sections 302. For example, a conductive face section 602 may be sized and arranged to oppose capacitive plate quadrants 502, 504 (see FIG. 5B) across gap 402. Similarly, conductive face section 604 may be sized and arranged to oppose capacitive plate quadrants 506, 508 (see FIG. 5B) across gap 402. Thus, the pairing of each capacitive face section with respective pairs of capacitive plate quadrants may form separate variable capacitor pairs. That is, in this example, a left and a right grouping of serially arranged variable capacitors may be provided to allow for capacitance of each grouping to be sensed separately. Separate sensing of variable capacitor pairs may allow for diaphragm position to be determined for different diaphragm regions. For example, a position of a left side of diaphragm 204 corresponding to capacitive plate quadrants 502, 504 and a position of a right side of diaphragm 204 corresponding to capacitive plate quadrants 506, 508 may be independently determined, as described below.

Figure 7:
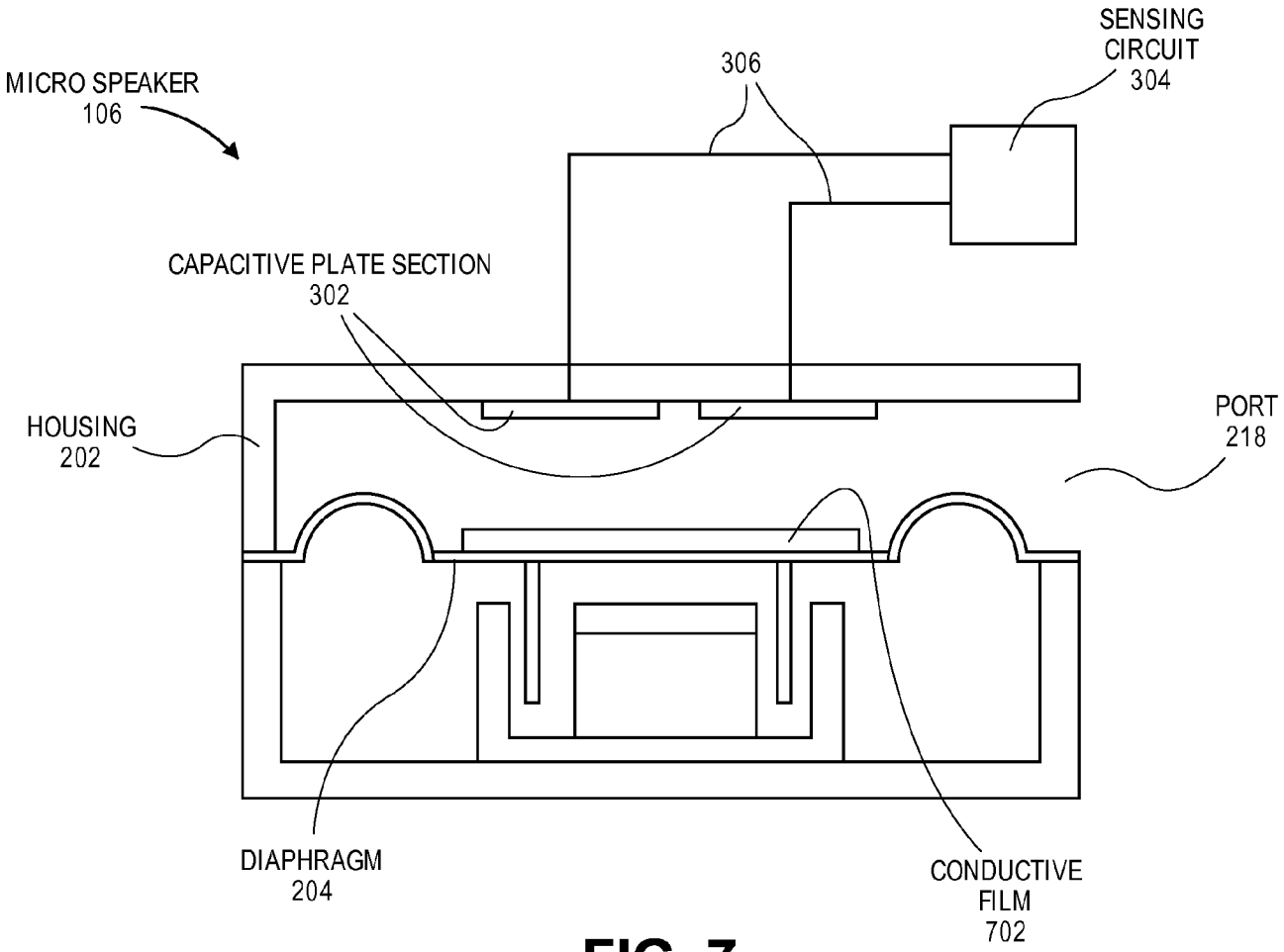
FIG. 7 is a sectional view of a side-firing micro speaker having a capacitive sensor in accordance with an embodiment.

Referring to FIG. 7, a sectional view of a side-firing micro speaker having a capacitive sensor is shown in accordance with an embodiment. In an embodiment, the segmented capacitive plate may be integrated on a front cover of housing 202 in front of diaphragm 204. For example, micro speaker 106 may be a side-firing speaker with port 218 located on a side of housing 202. Several capacitive plate sections 302 may be located on an inner surface of housing 202 opposite from a front conductive surface of diaphragm 204, e.g., upper layer 412. In an embodiment, a separate conductive film 702 may be deposited, printed, or otherwise layered over diaphragm 204 to provide a continuous conductive portion that forms a variable capacitor with respective capacitive plate sections 302. For example, the left capacitive plate section 302 may form a first variable capacitor with a respective region of conductive film 702 and the right capacitive plate section 302 may form a second variable capacitor with a respective region of conductive film 702. The variable capacitors may be serially arranged, as discussed above. Furthermore, the variable capacitors may be electrically connected with sensing circuit 304 through electrical leads 306. Accordingly, serially arranged variable capacitors may be incorporated on the front cover of a micro speaker 106 such that a distance between diaphragm 204 and the front cover may be sensed without placing electrical connections or integrated circuits on diaphragm 204.

It will be appreciated that the arrangement incorporating capacitive plate sections 302 in front of diaphragm 204 may include some of the same features described above with respect to embodiments having the capacitive plate sections 302 behind diaphragm 204. For example, the capacitive plate sections 302 on the front cover of housing 202 may be separated by slot 420 and have any of the patterns described in FIGS. 5A-5C. Furthermore, the illustration of front-mounted capacitive plate sections 302 in a side-firing micro speaker 106 is not intended to be limiting. For example, capacitive plate sections 302 may be mounted on a front cover in a front-firing speaker as well. In such case, a hole may extend through housing 202 along slot 420 to allow sound generated by diaphragm movement to radiate into the surrounding environment in a forward direction from the micro speaker 106. Alternatively, capacitive plate sections 302 may be formed from perforated or mesh material, or otherwise fitted with holes, to permit forward sound emission by the micro speaker 106.

In the embodiments described above, a respective capacitance of each variable capacitor in the system may be sensed. That is, sensing circuit 304 may receive feedback signals through electrical leads 306 that correlate with capacitance between one or more conductive surface 406 and an opposing conductive face 404. More particularly, the capacitance may correlate with a voltage between the conductive surface 406 and the conductive face 404. Furthermore, the capacitance depends on a distance between conductive surface 406 and conductive face 404, e.g., across gap 402 distance. Thus, as the conductive surfaces move relative to each other, the capacitance will vary, and accordingly, the voltage will vary. Voltage variations may be sensed by sensing circuit 304 to calculate the distance between gap 402. Alternatively, the voltage or other feedback signal may be sensed by sensing circuit 304 and used to calculate displacement of the surfaces, and thus, the displacement of diaphragm 204 in real-time.

In an embodiment, capacitive plate sections 302 may be sensed together. For example, capacitances associated with all capacitive plate sections 302 may be sensed at once. In an embodiment, this may be done by sensing a voltage at two capacitive plate sections 302 in a series of three or more variable capacitors. In such case, the sensed voltages would correspond to voltage changes in all of the serially arranged variable capacitors. Sensing all of the capacitive plate sections 302 together in this manner may provide for a higher signal to noise ratio.

Alternatively, capacitive plate sections 302 may be detected in groups, rather than all together. This may provide for detection of a rocking motion of diaphragm 204. In an embodiment, sensing circuit 304 may be able to switch between pairs of electrical leads 306, to allow for sensing of any grouping of variable capacitors at a time. For example, with respect to the embodiment shown in FIG. 5A, a voltage of the capacitive plate sections 302 at the 2 o'clock and 6 o'clock positions may be sensed by switching to connect to the appropriate electrical leads. Separately, a voltage of the capacitive plate sections 302 at the 6 o'clock and 10 o'clock positions, and a voltage of the capacitive plate sections 302 at the 10 o'clock and 2 o'clock positions may be sensed by indexing to connect to the appropriate electrical leads. Accordingly, voltage measurements for each pair of plate segments may be sensed and used to calculate a displacement of the plate pairs. Such displacements may be used to determine rocking motions of diaphragm 204. For example, when the calculated displacement for the capacitive plate sections 302 at the 2 o'clock and 6 o'clock positions is greater than the displacement for the capacitive plate sections 302 at the 10 o'clock and 2 o'clock position, it may be inferred that the diaphragm 204 is rocking toward the 4 o'clock radial direction more than toward the 12 o'clock radial direction. Similarly, where displacements calculated from all plate section capacitances are substantially the same, it may be inferred that diaphragm 204 is exhibiting pistonic, i.e., substantially axial, motion. Accordingly, an audio speaker having three or more capacitive plate sections 302 supported behind diaphragm 204 on magnet 212 may be used to sense displacement of diaphragm 204. Also, non-axial motion, e.g., rocking, bending, or other modes of undesirable operation, may be detected.

In another embodiment, separate groups of serially arranged variable capacitors may include a pair of capacitive plate quadrants 502, 504, representing a left side of micro speaker 106 (see, e.g., FIG. 5B) and a pair of capacitive plate quadrants 506, 508, representing a right side of micro speaker 106 (see, e.g., FIG. 5B). As described above, the capacitive plate quadrant pairs corresponding to the serially arranged variable capacitors may be electrically in series through a shared conductive surface of diaphragm. Thus, sensing circuit 304 may sense a first electrical signal, e.g., a voltage, through electrical leads connected to quadrants 502, 504, and may sense a second electrical signal through electrical leads connected to quadrants 506, 508. Accordingly, the left-side variable capacitor output may be sensed and processed separately from the right-side variable capacitor output. Additional pairs of variable capacitors, such as where the capacitive plate section grid has more than two intersecting slots, may be simultaneously sensed. Accordingly, as more and more pairs of variable capacitors are sensed, a more complex model of diaphragm motion may be determined. Alternatively, the shared capacitive plate on the moving diaphragm may also be divided into multiple sections rather than a single larger plate.

Figure 8:
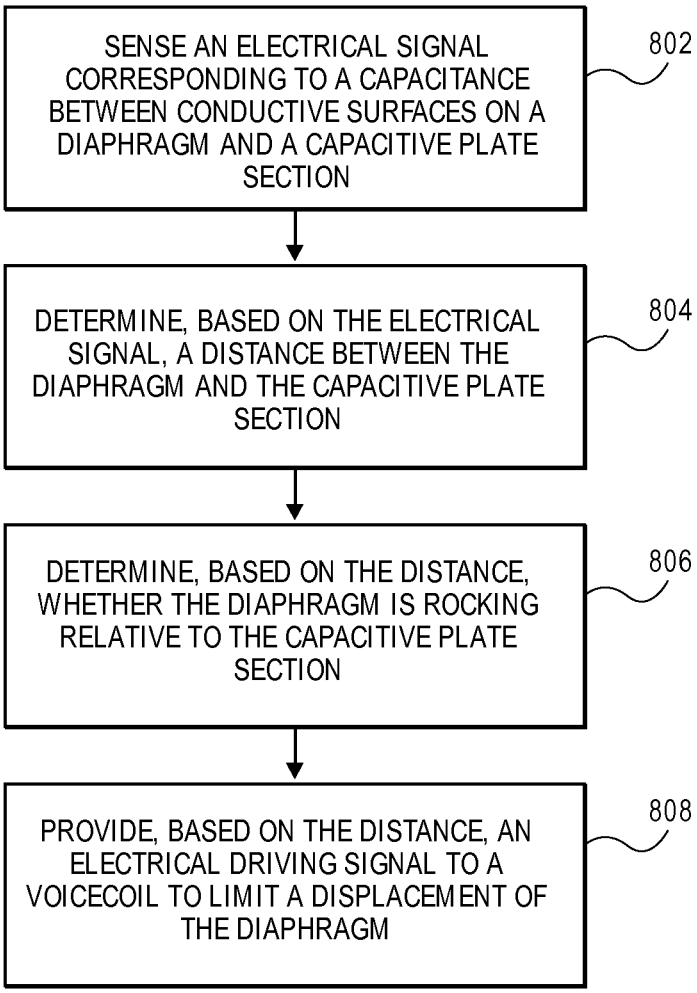
FIG. 8 is a flowchart of a method to monitor and/or control a spatial orientation of a micro speaker diaphragm in accordance with an embodiment.

Referring to FIG. 8, a flowchart of a method to monitor and/or control spatial orientation of a micro speaker diaphragm is shown in accordance with an embodiment. In an embodiment, at process 802, sensing circuit 304 senses electrical signals from one or more electrical leads 306 connected to one or more capacitive plate sections 302. For example, sensing circuit 304 may detect a voltage of the capacitive plate sections 302. In an embodiment, a bias voltage may be applied to the capacitive plate sections 302, e.g., through electrical leads 306, to create an electrical charge on the plates. The sensed voltage may be equal to, or different than, the applied bias voltage. For example, when diaphragm 204 is in a neutral position, the bias voltage and the sensed voltage may be the same, but as the diaphragm 204 moves, a capacitance between diaphragm 204 and the capacitive plate section 302 may change resulting in a sensed voltage that differs from the bias voltage. Thus, the sensed voltage, or a difference between the sensed voltage and the bias voltage, may correspond to capacitance between conductive face 404 of diaphragm 204 and respective conductive surfaces 406 of capacitive plate sections 302.

At process 804, the electrical signals sensed by sensing circuit 304 may be used to determine a relative spatial orientation between diaphragm 204 and capacitive plate sections 302. More particularly, given that the electrical signals correspond to capacitance, sensing circuit 304 may determine the instantaneous capacitances from the sensed electrical signals. More particularly, changes in capacitance relative to a neutral position of diaphragm 204 may be determined. Furthermore, since capacitance relates to displacement, the capacitance values may be used to calculate a displacement of diaphragm 204 and/or a distance between diaphragm 204 and capacitive plate section 302, i.e., a gap 402 distance. In an embodiment, the gap distance in the neutral position may be known, e.g., gap 402 may be 1 mm. Accordingly, changes in the capacitance may be used to calculate displacement of diaphragm 204, and in turn, the displacement may be added or subtracted from the known gap distance to determine a new gap distance corresponding to an absolute diaphragm position relative to capacitive plate sections 302.

At process 806, the absolute diaphragm position, i.e., the distance between diaphragm 204 and capacitive plate sections 302, may be used to determine in real-time whether diaphragm 204 is rocking relative to capacitive plate sections 302. For example, respective distances between several serially arranged variable capacitor pairs may be calculated to determine the relative spatial orientation between diaphragm 204 and the arrangement of capacitive plate sections 302. The respective distances calculated for each variable capacitor pair may be used to determine whether diaphragm 204 motion is pistonic or non-pistonic. For example, if respective distances of variable capacitor groupings at diametrically opposite portions of diaphragm 204 are different, e.g., a distance of a first variable capacitor grouping at one side of diaphragm 204 is more than the neutral position gap 402 while a distance of a second variable capacitor grouping at another side of diaphragm 204 is less than the neutral position gap, then it may be inferred that diaphragm 204 is rocking, tilting, or tipping toward one of the two sides. Additional distances may be sensed to infer more complex motions of diaphragm 204. For example, the use of at least four capacitive plate sections 302 may be used to detect rocking modes in multiple axes, diaphragm bending modes, etc.

At process 808, the calculated diaphragm position may be used to actively control motion of diaphragm 204. For example, a feedback loop may be created for open or closed loop control of diaphragm motion. The setpoint in the control loop may be a desired diaphragm position and the feedback signal may be the various displacement and/or distance values that are calculated in real time for diaphragm 204. The calculated values may be compared to the setpoint to create a control signal for driving the diaphragm 204 to the desired position. In an embodiment, the desired diaphragm position may take into account the excursion limits of the micro speaker 106. For example, when gap 402 has a known neutral position distance, the desired position may be limited to be within the neutral position distance to prevent diaphragm 204 from crashing into capacitive plate sections 302 supported on magnet 212, or housing 202, during sound generation. Accordingly, the electrical driving signal delivered to voicecoil 210 to generate sound may be adjusted to limit diaphragm displacement to within the excursion limits. Similarly, the desired position may not only limit diaphragm motion to within the excursion limits, but may also be used to drive the diaphragm 204 as close to the excursion limits as possible, thereby maximizing output level within the constraints of the system. It will be appreciated that active control and monitoring of diaphragm position may also be used to compensate for nonlinear distortion in the micro speaker 106. Accordingly, a micro speaker 106 having capacitive position sensing for diaphragm 204 may exhibit desirable sound output and quality, while being less likely to fail mechanically.

Figure 9:
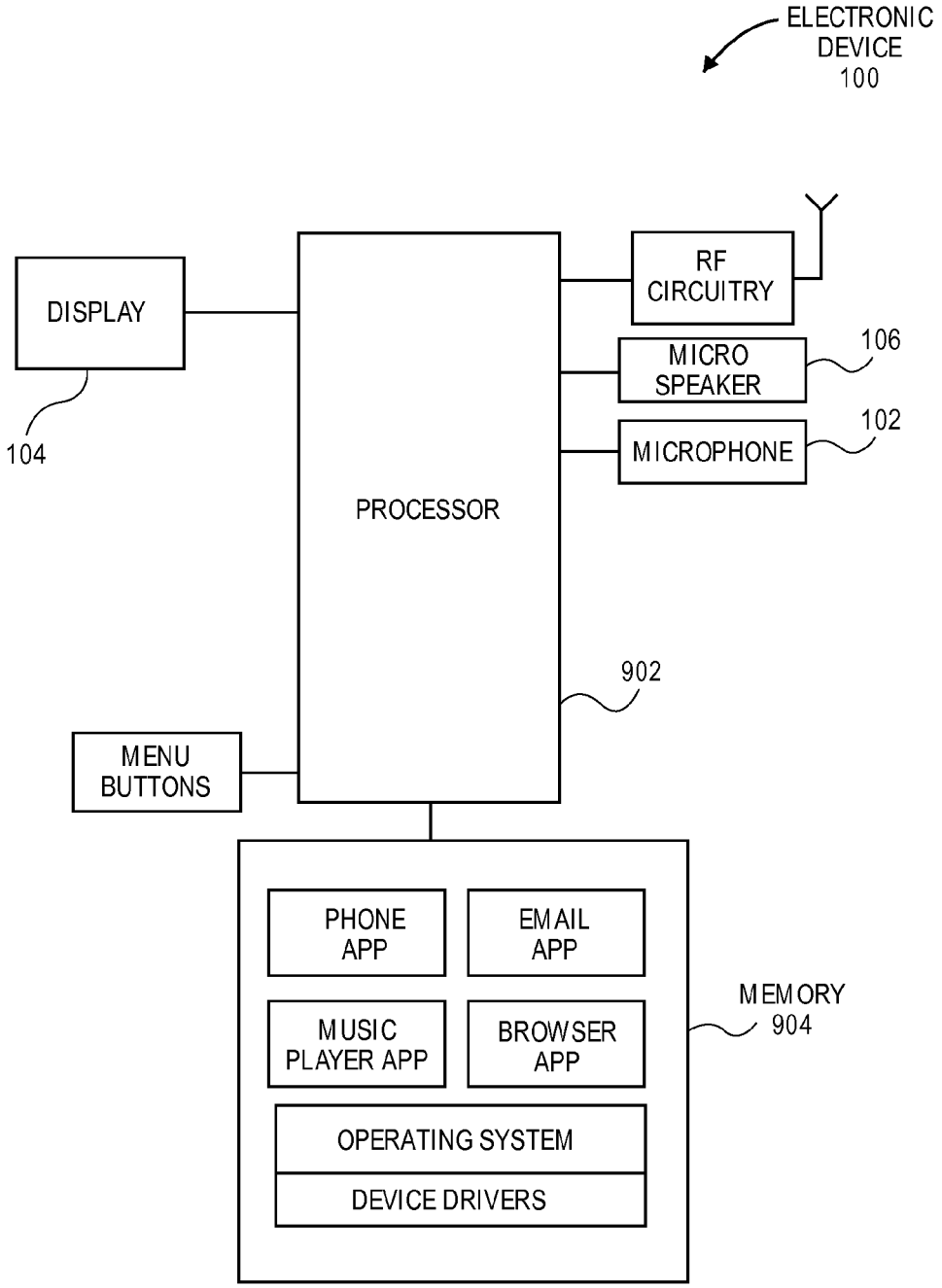
FIG. 9 is a schematic view of an electronic device having a micro speaker in accordance with an embodiment.

Referring to FIG. 9, a schematic view of an electronic device having a micro speaker is shown in accordance with an embodiment. As described above, electronic device 100 may be one of several types of portable or stationary devices or apparatuses with circuitry suited to specific functionality. Thus, the diagrammed circuitry is provided by way of example and not limitation. Electronic device 100 may include one or more processors 902 that execute instructions to carry out the different functions and capabilities described above. For example, processor 902 may incorporate and/or communicate with sensing circuit 304, as well as digital signal processors or other electronics connected to sensing circuit 304, to determine capacitances of micro speaker components and calculate a relative spatial orientation of diaphragm 204 based on such capacitances. Furthermore, processor 902 may directly or indirectly implement control loops and provide drive signals to voicecoil 210 of micro speaker 106 to limit diaphragm motion to within an available travel. Instructions executed by the one or more processors 902 of electronic device 100 may be retrieved from local memory 904, and may be in the form of an operating system program having device drivers, as well as one or more application programs that run on top of the operating system, to perform the different functions introduced above, e.g., phone or telephony and/or music play back. Audio output for telephony and music play back functions may be through an audio speaker, such as micro speaker 106.

In the foregoing specification, the invention has been described with reference to specific exemplary embodiments thereof. It will be evident that various modifications may be made thereto without departing from the broader spirit and scope of the invention as set forth in the following. claims. The specification and drawings are, accordingly, to be regarded in an illustrative sense rather than a restrictive sense.

What is claimed is:

1. A micro speaker, comprising:

a diaphragm having a conductive surface;

a motor assembly coupled with the diaphragm, wherein the motor assembly includes a voicecoil and a plurality of magnetic stacks behind the diaphragm configured to move the diaphragm to emit sound forward away from the magnetic stacks, wherein the magnetic stacks are separated from each other by one or more vertical slots filled by a dielectric, and wherein each magnetic stack includes a magnet portion, and a capacitive plate section mounted on the magnet portion, wherein each capacitive plate section includes a respective conductive surface facing the conductive surface of the diaphragm across a gap distance; and a sensing circuit electrically connected with the capacitive plate section.

2. The micro speaker of claim 1, wherein the plurality of magnetic stacks include at least three capacitive plate sections electrically insulated from each other across the one or more vertical slots.

3. The micro speaker of claim 2, wherein the one or more vertical slots include a pair of intersecting vertical slots, and wherein the at least three capacitive plate sections includes capacitive plate quadrants separated by the pair of intersecting vertical slots.

4. The micro speaker of claim 3, wherein each magnetic stack includes an insulating layer between the capacitive plate section and the magnet portion.

5. The micro speaker of claim 4, wherein the dielectric includes an insulating filler.

6. The micro speaker of claim 4 further comprising an electrical lead extending from a respective capacitive plate section to the sensing circuit, wherein the electrical lead electrically connects the respective capacitive plate section with the sensing circuit.

7. The micro speaker of claim 6, wherein the sensing circuit is configured to measure a capacitance of the facing conductive surfaces of the diaphragm and the respective capacitive plate section.

8. The micro speaker of claim 7, wherein the sensing circuit is configured to calculate displacement of the diaphragm based on the measured capacitance.

9. The micro speaker of claim 4 further comprising a housing in front of the diaphragm, the housing including a port configured to pass the sound emitted by the diaphragm.

10. The micro speaker of claim 4, wherein the gap distance is less than 3 mm.

11. The micro speaker of claim 10, wherein the gap distance is less than 1 mm.

12. A method, comprising:

sensing one or more electrical signals, each electrical signal corresponding to one or more capacitances of facing conductive surfaces of a diaphragm of a micro speaker and one or more capacitive plate sections of a plurality of magnetic stacks of the micro speaker, wherein the diaphragm is configured to emit sound forward away from the magnetic stacks of the micro speaker, wherein the magnetic stacks are behind the diaphragm, wherein each magnetic stack includes a magnet portion and a capacitive plate section, and wherein the magnetic stacks are separated from each other by one or more vertical slots filled by a dielectric; and determining, based on the electrical signals, a relative spatial orientation between the diaphragm and the one or more capacitive plate sections.

13. The method of claim 12, wherein the one or more vertical slots include a pair of intersecting vertical slots, and wherein the one or more capacitive plate sections includes at least three capacitive plate sections.

14. The method of claim 13, wherein each capacitive plate section is supported on a respective magnet portion, and wherein the capacitive plate sections and magnet portions are electrically insulated from each other.

15. The method of claim 14, wherein a distance between the diaphragm and each of the one or more capacitive plate sections is less than 3 mm.

16. The method of claim 15, wherein the distance is less than 1 mm.

17. The method of claim 16, wherein determining the relative spatial orientation includes detecting respective distances between the diaphragm and one or more pairs of the one or more capacitive plate sections.

18. The method of claim 17, wherein determining the relative spatial orientation includes determining, based on the detected distances, whether the diaphragm is rocking relative to the one or more capacitive plate sections.

19. The method of claim 18 further comprising:

providing an electrical driving signal to a voicecoil of the micro speaker based on the detected distances to limit a displacement of the diaphragm within an available travel of the diaphragm.

* * * * *